US010760329B1

(12) United States Patent
Maas et al.

(10) Patent No.: US 10,760,329 B1
(45) Date of Patent: Sep. 1, 2020

(54) FENESTRATION FRAMES WITH INTEGRAL MULL POSTS AND METHODS OF MAKING SAME

(71) Applicant: ANDERSEN CORPORATION, Bayport, MN (US)

(72) Inventors: Andrew Maas, St. Paul, MN (US); Joseph Guy Reithmeyer, Afton, MN (US); Duane Fier, Hudson, WI (US); Shawn Miller, Osceola, WI (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 16/253,666

(22) Filed: Jan. 22, 2019

Related U.S. Application Data

(60) Provisional application No. 62/621,994, filed on Jan. 25, 2018.

(51) Int. Cl.
*E06B 3/96* (2006.01)
*E06B 3/06* (2006.01)

(52) U.S. Cl.
CPC ..... *E06B 3/9632* (2013.01); *E06B 3/06* (2013.01)

(58) Field of Classification Search
CPC . E06B 3/9632; E06B 3/06; E06B 1/36; E06B 1/524; E06B 1/366; E06B 3/96
USPC ..... 52/204.1, 204.5, 204.6, 656.5, 656.6, 52/656.7, 207, 211, 656.4
See application file for complete search history.

(56) References Cited

U.S. PATENT DOCUMENTS 3,340,663 A * 9/1967 Collard ..... E04B 2/96 52/775
3,579,943 A * 5/1971 Tam ..... E06B 1/18 52/656.2
3,962,774 A * 6/1976 Noro ..... E04F 11/1817 29/432
4,016,695 A * 4/1977 Stoakes ..... E04B 2/90 52/476
4,214,405 A * 7/1980 Chupik ..... E06B 1/524 49/382
4,219,971 A * 9/1980 Mauroner ..... E05D 15/08 49/372
4,956,940 A * 9/1990 Touton, III ..... E06B 3/9632 16/379
5,524,391 A * 6/1996 Joffe ..... E06B 1/524 49/467
5,585,155 A 12/1996 Heikkila et al.
5,603,585 A 2/1997 Bruchu et al.
6,106,944 A 8/2000 Heikkila et al.
6,210,792 B1 4/2001 Seethamraju et al.
6,260,251 B1 6/2001 Guhl
6,280,667 B1 8/2001 Koenig et al.
6,342,172 B1 1/2002 Finley
6,408,922 B2 * 6/2002 Desrochers ..... E06B 9/54 160/24
6,412,240 B1 * 7/2002 Treleven ..... E06B 1/02 52/204.53
6,530,183 B1 * 3/2003 Kuei-Yung ..... E06B 1/26 49/504
7,788,863 B2 * 9/2010 Pepper ..... E06B 3/365 49/467

(Continued)

*Primary Examiner* — Brian E Glessner
*Assistant Examiner* — Adam G Barlow
(74) *Attorney, Agent, or Firm* — Mueting Raasch Group

(57) ABSTRACT

Fenestration unit frames with integral mull posts and methods of making the same are described herein.

26 Claims, 11 Drawing Sheets

(56) References Cited

U.S. PATENT DOCUMENTS

| | | | | |
|---|---|---|---|---|
| 8,266,851 | B2 * | 9/2012 | Campbell | E06B 1/366 403/187 |
| 8,851,787 | B2 | 10/2014 | Kelley et al. | |
| 10,550,631 | B2 * | 2/2020 | Wang | E06B 3/222 |
| 2003/0221381 | A1 * | 12/2003 | Ting | E06B 1/36 52/204.1 |
| 2004/0128925 | A1 * | 7/2004 | Massey | E06B 1/6092 52/204.1 |
| 2006/0010796 | A1 * | 1/2006 | Akutsu | E06B 3/28 52/204.5 |
| 2006/0150517 | A1 * | 7/2006 | Meeks | E05C 1/04 49/368 |
| 2008/0028701 | A1 * | 2/2008 | White | E06B 3/86 52/207 |
| 2008/0229668 | A1 * | 9/2008 | Meeks | E06B 3/365 49/367 |
| 2009/0013624 | A1 * | 1/2009 | Sibbett | E06B 3/9687 52/204.62 |
| 2010/0282137 | A1 * | 11/2010 | Neal | E06B 3/68 109/77 |
| 2013/0000232 | A1 * | 1/2013 | Weiss | E06B 3/06 52/204.6 |
| 2015/0121788 | A1 * | 5/2015 | Kim | E06B 3/16 52/309.1 |
| 2019/0093416 | A1 * | 3/2019 | Luvison | E04B 2/967 |

* cited by examiner

FENESTRATION FRAMES WITH INTEGRAL MULL POSTS AND METHODS OF MAKING SAME

RELATED APPLICATION

This application claims the benefit under 35 U.S.C. Section 119 of U.S. Provisional Patent Application Ser. No. 62/621,994 entitled "FENESTRATION FRAMES WITH INTEGRAL MULL POSTS AND METHODS OF MAKING SAME" and filed on Jan. 25, 2018, which is incorporated herein by reference in its entirety.

Fenestration unit frames with integral mull posts and methods of making the same are described herein.

Fenestration unit frames used in a variety of fenestration units may include an integral mull such that two or more windows, doors, etc. may be provided in a single unitary frame having one or more mull joints located therein. In one or more embodiments, the corners of the fenestration unit frames may include weldable frame components that are connected by welding the ends of the frame components together at each corner.

Weldable frame components along with methods of welding corner joints formed by those frame components to form fenestration unit frames are described in, e.g., U.S. Pat. No. 5,603,585 (Bruchu et al.). Although U.S. Pat. No. 5,603,585 does teach the joining of fenestration units together using a mulling strip, the mulling strip is not integrally located within a fenestration unit frame, but is, rather, used to connect two fenestration unit frames together.

SUMMARY

Fenestration unit frames with integral mull posts and methods of making the same are described herein.

In one or more embodiments, the integral mull posts (in the form of intermediate jambs) are supported and aligned with the jambs located at their opposing ends (e.g., sill and head jambs) using keys (e.g., sill and head keys) before complete assembly and connection of the corner joints of the fenestration unit frames.

In one or more embodiments of the fenestration unit frames described herein, the keys used at the ends of the integral mull posts may allow for an interlocking connection between the ends of the integral mull posts and the jambs located at the ends of the integral mull posts as described herein.

In a first aspect, one or more embodiments of a fenestration unit frame as described herein may include: a sill jamb extending along a sill axis between a first end and a second end; a head jamb extending along a head axis between a first end and a second end; a first side jamb extending between the first end of the sill jamb and the first end of the head jamb, wherein a first sill corner joint connects the first side jamb to the first end of the sill jamb and a first head corner joint connects the first side jamb to the first end of the head jamb; a second side jamb extending between the second end of the sill jamb and the second end of the head jamb, wherein a second sill corner joint connects the second side jamb to the second end of the sill jamb and a second head corner joint connects the second side jamb to the second end of the head jamb; an intermediate jamb extending along an intermediate jamb axis between the sill jamb and the head jamb at a location between the first side jamb and the second side jamb, wherein a sill end of the intermediate jamb and the sill jamb form an interlocking sill connection that prevents movement of the sill end relative to the sill jamb in a direction transverse to both the sill axis and the intermediate jamb axis, and wherein a head end of the intermediate jamb and the head jamb form an interlocking head connection that prevents movement of the head end relative to the head jamb in a direction transverse to both the head axis and the intermediate jamb axis; a sill key attached to the sill jamb, wherein the sill key comprises a sill key base proximate the sill and a sill key post extending away from the sill key base along the intermediate jamb axis, wherein the sill key post extends into a sill end cavity in the sill end of the intermediate jamb; and a head key attached to the head jamb, wherein the head key comprises a head key base proximate the head and a head key post extending away from the head key base along the intermediate jamb axis, wherein the head key post extends into a head end cavity in the head end of the intermediate jamb.

In one or more embodiments of a fenestration unit frame as described herein, the interlocking sill connection defines an interlocking sill connection distance measured along the intermediate jamb axis and wherein the sill key post extends into the sill end cavity over a post-cavity distance that is greater than the interlocking sill connection distance. In one or more embodiments, the interlocking head connection defines an interlocking head connection distance measured along the intermediate jamb axis and wherein the head key post extends into the head end cavity over a post-cavity distance that is greater than the interlocking head connection distance.

In one or more embodiments of a fenestration unit frame as described herein, the sill key post comprises a sill post end distal from the sill along the intermediate jamb axis, and wherein the interlocking sill connection comprises a terminal junction distal from the sill jamb along the intermediate jamb axis, and further wherein the terminal junction of the interlocking sill connection is located between the sill key base and the sill post end.

In one or more embodiments of a fenestration unit frame as described herein, the head key post comprises a head post end distal from the head along the intermediate jamb axis, and wherein the interlocking head connection comprises a terminal junction distal from the head jamb along the intermediate jamb axis, and further wherein the terminal junction of the interlocking head connection is located between the head key base and the head post end.

In one or more embodiments of a fenestration unit frame as described herein, the sill key post comprises a first sill key post, and wherein the sill key comprises a second sill key post extending away from the sill key base along the intermediate jamb axis, wherein the second sill key post extends into a second sill end cavity in the sill end of the intermediate jamb.

In one or more embodiments of a fenestration unit frame as described herein, the head key post comprises a first head key post, and wherein the head key comprises a second head key post extending away from the head key base along the intermediate jamb axis, wherein the second head key post extends into a second head end cavity in the head end of the intermediate jamb.

In one or more embodiments of a fenestration unit frame as described herein, the interlocking sill connection comprises a sill rail, and wherein the sill end of the intermediate jamb comprises a channel configured to receive the sill rail to form the interlocking connection. In one or more embodiments, the sill rail extends along the entire length of the sill jamb from the first end to the second end of the sill jamb. In one or more embodiments, the sill rail comprises a sill rail top and wherein the sill key post comprises a sill post end distal from the sill along the intermediate jamb axis, and wherein the sill rail top is located between the sill key base and the sill post end.

In one or more embodiments of a fenestration unit frame as described herein, the interlocking head connection comprises a head rail, and wherein the head end of the intermediate jamb comprises a channel configured to receive the head rail to form the interlocking connection. In one or more embodiments, the head rail extends along the entire length of the head jamb from the first end to the second end of the head jamb. In one or more embodiments, the head rail comprises a head rail top and wherein the head key post comprises a head post end distal from the head along the intermediate jamb axis, and wherein the head rail top is located between the head key base and the head post end.

In one or more embodiments of a fenestration unit frame as described herein, the first sill corner joint and the first head corner joint comprise welded corner joints.

In a second aspect, one or more embodiments of a method of manufacturing a fenestration unit frame as described herein may include: attaching a sill key to the sill jamb at an intermediate location between a first end and a second end of the sill jamb, wherein the sill key comprises a sill key base proximate the sill and a sill key post extending away from the sill key base along the intermediate jamb axis; attaching a head key to the head jamb at an intermediate location between a first end and a second end of the head jamb, wherein the head key comprises a head key base proximate the head and a head key post extending away from the head key base along the intermediate jamb axis; positioning the first side jamb between the first end of the sill jamb and the first end of the head jamb; positioning the second side jamb between the second end of the sill jamb and the second end of the head jamb; positioning the intermediate jamb between the sill jamb and the head jamb at a location between the first side jamb and the second side jamb, wherein an intermediate jamb axis extends along the intermediate jamb between a sill end proximate the sill jamb and a head end proximate the head jamb; inserting a portion of the sill key post into a sill end cavity in the sill end of the intermediate jamb after attaching the sill key to the sill jamb and after positioning the intermediate jamb between the sill jamb and the head jamb; inserting a portion of the head key post into a head end cavity in the head end of the intermediate jamb after attaching the head key to the head jamb and after positioning the intermediate jamb between the sill jamb and the head jamb; connecting the first end of the sill jamb and the first end of the head jamb to opposite ends of the first side jamb to form corner joints at the opposite ends of the first side jamb after inserting the portion of the sill key post into the sill end cavity in the sill end of the intermediate jamb and after inserting the portion of the head key post into the head end cavity in the head end of the intermediate jamb; connecting the second end of the sill jamb and the second end of the head jamb to opposite ends of the second side jamb to form corner joints at the opposite ends of the second side jamb after inserting the portion of the sill key post into the sill end cavity in the sill end of the intermediate jamb and after inserting the portion of the head key post into the head end cavity in the head end of the intermediate jamb; forming an interlocking sill connection between the sill end of the intermediate jamb and the sill jamb by moving the sill jamb and the sill end of the intermediate jamb closer to each other such that the sill key post advances to a fully seated position in the sill end cavity of the intermediate jamb before forming the corner joints at the first and second ends of the sill jamb, wherein the interlocking connection between the sill end of the intermediate jamb and the sill jamb prevents movement of the sill end relative to the sill jamb in a direction transverse to both a sill axis extending between the first and second ends of the sill jamb and an intermediate jamb axis extending along the intermediate jamb between the sill jamb and the head jamb; and forming an interlocking head connection between the head end of the intermediate jamb and the head jamb by moving the head jamb and the head end of the intermediate jamb closer to each other such that the head key post advances to a fully seated position in the head end cavity of the intermediate jamb before forming the corner joints at the first and second ends of the head jamb, wherein the interlocking connection between the head end of the intermediate jamb and the head jamb prevents movement of the head end relative to the head jamb in a direction transverse to both a head axis extending between the first and second ends of the head jamb and an intermediate jamb axis extending along the intermediate jamb between the sill jamb and the head jamb.

In one or more embodiments of a method of manufacturing a fenestration unit frame as described herein, the interlocking sill connection defines an interlocking sill connection distance measured along the intermediate jamb axis and wherein the sill key post extends into the sill end cavity over a post-cavity distance that is greater than the interlocking sill connection distance. In one or more embodiments, the interlocking head connection defines an interlocking head connection distance measured along the intermediate jamb axis and wherein the head key post extends into the head end cavity over a post-cavity distance that is greater than the interlocking head connection distance.

In one or more embodiments of a method of manufacturing a fenestration unit frame as described herein, the sill key post comprises a sill post end distal from the sill along the intermediate jamb axis, and wherein the interlocking sill connection comprises a terminal junction distal from the sill jamb along the intermediate jamb axis, and further wherein the terminal junction of the interlocking sill connection is located between the sill key base and the sill post end.

In one or more embodiments of a method of manufacturing a fenestration unit frame as described herein, the head key post comprises a head post end distal from the head along the intermediate jamb axis, and wherein the interlocking head connection comprises a terminal junction distal from the head jamb along the intermediate jamb axis, and further wherein the terminal junction of the interlocking head connection is located between the head key base and the head post end.

In one or more embodiments of a method of manufacturing a fenestration unit frame as described herein, the sill key post comprises a first sill key post, and wherein the sill key comprises a second sill key post extending away from the sill key base along the intermediate jamb axis, wherein the second sill key post extends into a second sill end cavity in the sill end of the intermediate jamb.

In one or more embodiments of a method of manufacturing a fenestration unit frame as described herein, the head key post comprises a first head key post, and wherein the head key comprises a second head key post extending away from the head key base along the intermediate jamb axis, wherein the second head key post extends into a second head end cavity in the head end of the intermediate jamb.

In one or more embodiments of a method of manufacturing a fenestration unit frame as described herein, the interlocking sill connection comprises a sill rail, and wherein the sill end of the intermediate jamb comprises a channel configured to receive the sill rail to form the interlocking connection. In one or more embodiments, the sill rail extends along the entire length of the sill jamb from the first end to the second end of the sill jamb.

In one or more embodiments of a method of manufacturing a fenestration unit frame as described herein, the sill rail comprises a sill rail top and wherein the sill key post comprises a sill post end distal from the sill along the intermediate jamb axis, and wherein the sill rail top is located between the sill key base and the sill post end.

In one or more embodiments of a method of manufacturing a fenestration unit frame as described herein, the interlocking head connection comprises a head rail, and wherein the head end of the intermediate jamb comprises a channel configured to receive the head rail to form the interlocking connection. In one or more embodiments, the head rail extends along the entire length of the head jamb from the first end to the second end of the head jamb. In one or more embodiments, the head rail comprises a head rail top and wherein the head key post comprises a head post end distal from the head along the intermediate jamb axis, and wherein the head rail top is located between the head key base and the head post end.

In one or more embodiments of a method of manufacturing a fenestration unit frame as described herein, connecting the first end of the sill jamb and the first end of the head jamb to opposite ends of the first side jamb to form corner joints comprises welding the first end of the sill jamb and the first end of the head jamb to opposite ends of the first side jamb.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Where used herein, the terms "top" and "bottom" are used for reference relative to each other when fenestration units are properly installed in a building opening.

Where used herein, the terms "exterior" and "interior" are used in a relative sense, e.g., an exterior edge and an interior edge of a sill or any other component describe edges located on opposite sides of the fenestration unit. In other words, an exterior edge could be found within the interior of a building or other structure that would conventionally define an interior and an exterior, while an interior edge could be found outside of a building or other structure that would conventionally define an interior and an exterior.

The above summary is not intended to describe each embodiment or every implementation of the fenestration unit frames with integral mull posts and methods of making the same described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
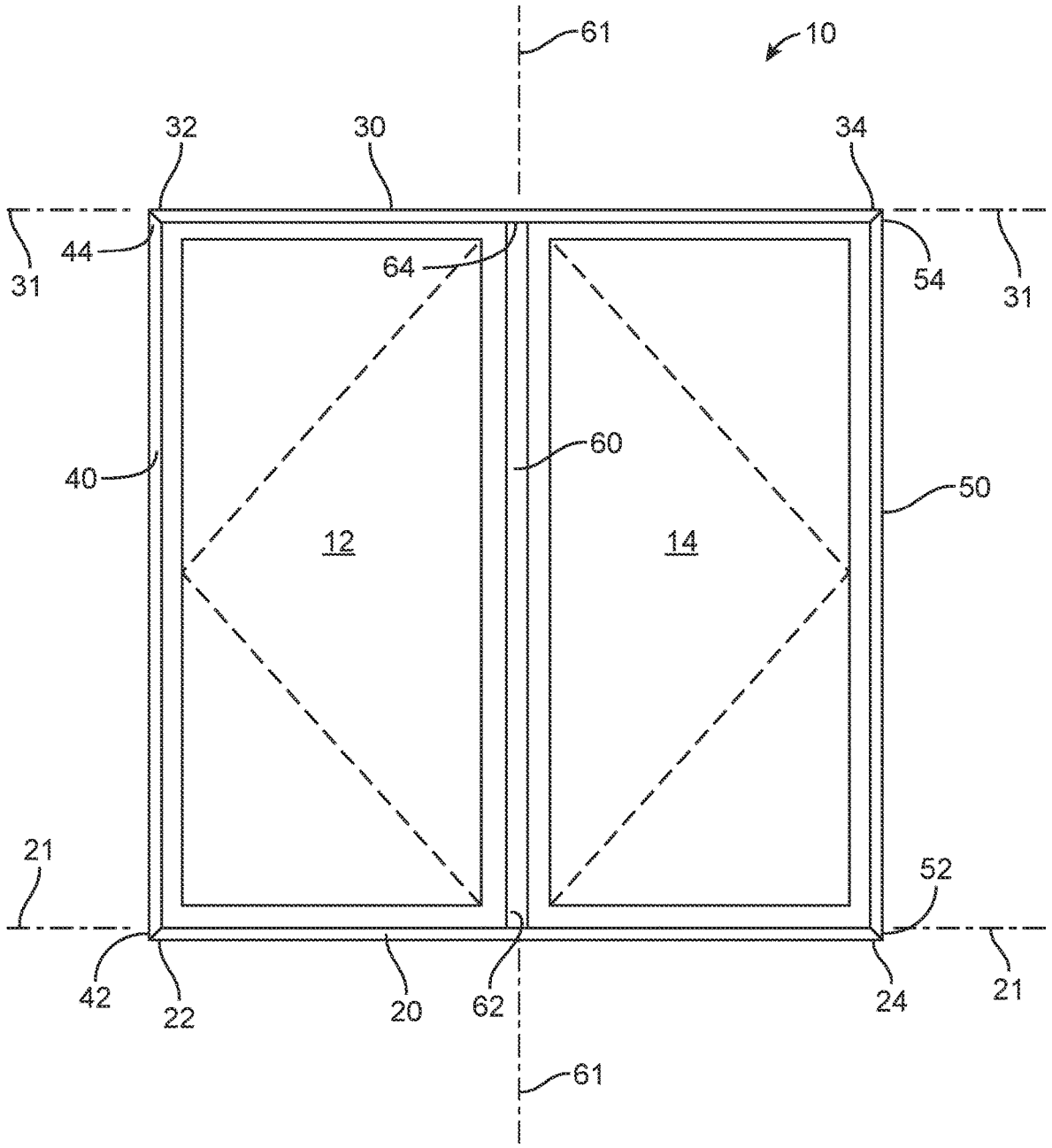
FIG. 1 depicts one illustrative embodiment of a fenestration unit in the form of a twin casement window having a fenestration unit frame including an integral mull post.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

Each of the corner joints of the fenestration unit frames described herein includes a pair of frame members that meet at a corner where a corner joint is formed to connect the frame members. The frame members may, in one or more embodiments, be attached to each other at the corner joints by welding portions of each frame member to the opposing frame member in the corner joint. Potentially suitable examples of welding corner joints are described in, e.g., U.S. Pat. No. 5,603,585 (Bruchu et al.) although other welding techniques could potentially be used to form the corner joints of fenestration unit frames as described herein. Although welding may be used to form corner joints in one or more embodiments of fenestration unit frames and methods as described herein, any other suitable technique or combination of techniques may be used to form corner joints, e.g., one or more of welding, adhesives, mechanical fasteners, etc. may be used to form corner joints in fenestration frames that include an integral mull post (intermediate jamb) as described herein.

In one or more embodiments of the fenestration unit frames and methods described herein, the corner joints in the fenestration unit frames may or may not include a corner key that fits within either end of the frame members to assist with aligning and/or fastening the frame members together at the corner joints (see, e.g., U.S. Pat. No. 8,851,787 (Kelley et al.) which describes frames and methods in which corner keys are used in fenestration unit frames). Although corner keys may be used in one or more embodiments of fenestration unit frames and methods described herein, in one or more alternative embodiments, the connection between the frame members and their alignment relative to each other at the corner joints to form the desired fenestration unit frame may be achieved in the absence of corner keys.

The frame members used in the fenestration unit frames described herein may be manufactured by a variety of processes. It may, however, be preferred that the frame members be manufactured of an extruded material which may, in one or more embodiments, include fibers and a polymer, pultruded materials, etc. Examples of some potentially suitable constructions for frame members that include fibers and a polymer may include those described in, e.g., U.S. Pat. No. 5,585,155 (Heikkila et al.); U.S. Pat. No. 6,106,944 (Heikkila et al.); U.S. Pat. No. 6,210,792 Seethamraju et al.); U.S. Pat. No. 6,260,251 (Guhl); U.S. Pat. No. 6,280,667 (Koenig et al.); U.S. Pat. No. 6,342,172 (Finley); etc. Alternatively, the frame members could be made primarily of polymeric materials such as, e.g., vinyls, etc.

FIG. 1 depicts one illustrative embodiment of a fenestration unit 10 in the form of a twin casement window. The fenestration unit 10 includes a fenestration unit frame including an integral mull post in the form of an intermediate jamb 60. Other components of the fenestration unit frame include a sill jamb 20, head jamb 30, left side jamb 40 and right side jamb 50. The intermediate jamb 60 extends between the sill jamb 20 and head jamb 30 and is located between left side jamb 40 and right side jamb 50. Casement windows 12 and 14 are located within the fenestration unit frame and separated from each other by intermediate jamb 60.

Sill jamb 20 as seen in FIG. 1 extends along a sill axis 21 between a first end 22 and a second end 24. Similarly, head jamb 30 extends along a head axis 31 between a first end 32 and a second end 34.

Left side jamb 40 extends between the first end 22 of sill jamb 20 and the first end 32 of head jamb 30. In the depicted illustrative embodiment, a sill corner joint connects the first end 42 of left side jamb 40 to the first end 22 of sill jamb 20 and a head corner joint connects the first end 32 of head jamb 30 to the second end 44 of left side jamb 40. In one or more embodiments, the sill corner joint and the head corner joint that may or may not include a corner key to assist in positioning and/or provide additional rigidity to the corner joints formed between the sill jamb 20, head jamb 30, and left side jamb 40.

Right side jamb 50 extends between the second end 24 of sill jamb 20 and the second end 34 of head jamb 30. In the depicted illustrative embodiment, a sill corner joint connects the first end 52 of the right side jamb 50 to the second end 24 of the sill jamb 20 and a head corner joint connects the second end 34 of head jamb 30 to the second end 54 of the right side jamb 50. As above, in one or more embodiments, the sill corner joint and the head corner joint formed on the right side of the fenestration unit frame may or may not include a corner key to assist in positioning and/or provide additional rigidity to the corner joints formed between the sill jamb 20, head jamb 30, and right side jamb 50.

Figure 2:
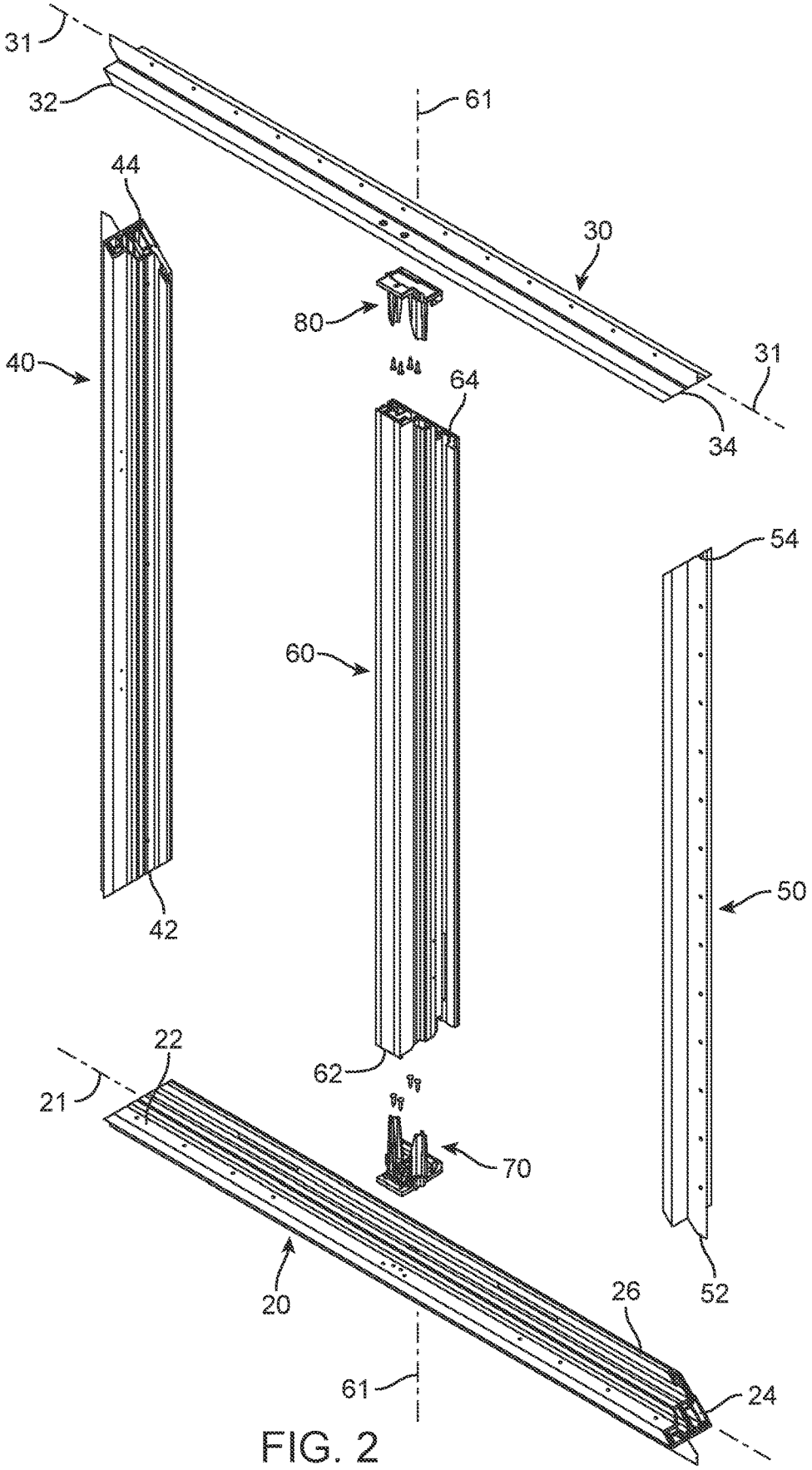
FIG. 2 is an exploded assembly diagram of the fenestration unit frame of the fenestration unit depicted in FIG. 1.

FIG. 2 is an exploded assembly diagram of the fenestration unit frame used in fenestration unit 10 as depicted in FIG. 1. In addition to the components and features described in FIG. 1, the exploded assembly diagram of FIG. 2 depicts, more clearly, various features regarding the intermediate jamb 60 provided as a part of the fenestration unit frame.

In one or more embodiments of fenestration unit frames as described herein, the intermediate jamb 60 extends along an intermediate jamb axis 61 between the sill jamb 20 and the head jamb 30 at a location between the left side jamb 40 and the right side jamb 50. A sill end 62 of the intermediate jamb 60 and the sill jamb 20 form an optional interlocking sill connection that prevents movement of the sill end 62 of the intermediate jamb 60 relative to the sill jamb 20 in a direction transverse to both the sill axis 21 and the intermediate jamb axis 61. A head end 64 of the intermediate jamb 60 and the head jamb 30 form an optional interlocking head connection that prevents movement of the head end 64 of the intermediate jamb 60 relative to the head jamb 30 in a direction transverse to both the head axis 31 and the intermediate jamb axis 61. That same interlocking connection also prevents placement of the intermediate jamb 60 between the sill jamb 20 and the head jamb 30 after the corner joints have been formed at the opposite ends of the left and right side jambs 40 and 50.

Attachment and fixation of the intermediate jamb 60 at selected locations along both the sill jamb 20 and the head jamb 30 are, in the depicted embodiment, accomplished using keys attached to the sill jamb 20 and the head jamb 30. In particular, a sill key 70 is attached to the sill jamb 20 and a sill key 80 is attached to the head jamb 30. In the depicted illustrative embodiment, the sill key 70 is attached to the sill jamb 20 and the head key 80 is attached to the head jamb 30 using threaded fasteners, although any suitable fastening technique or combination of techniques could be used in place of and/or in addition to threaded fasteners (e.g., adhesives, welding, rivets, etc.).

In the depicted illustrative embodiment, the fenestration unit frame members, i.e., sill jamb 20, head jamb 30, side jambs 40 and 50, each include mitered ends configured to mate with each other at the corner joints to facilitate strong welds at the corners of the fenestration unit frame. As discussed herein, the corner joints may or may not include corner keys.

Figure 4:
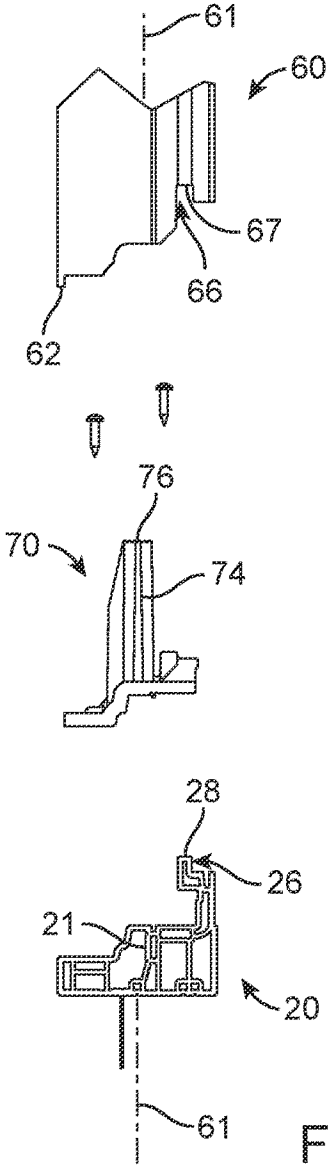
FIG. 4 is a side view of the enlarged exploded view of FIG. 3.
Figure 3:
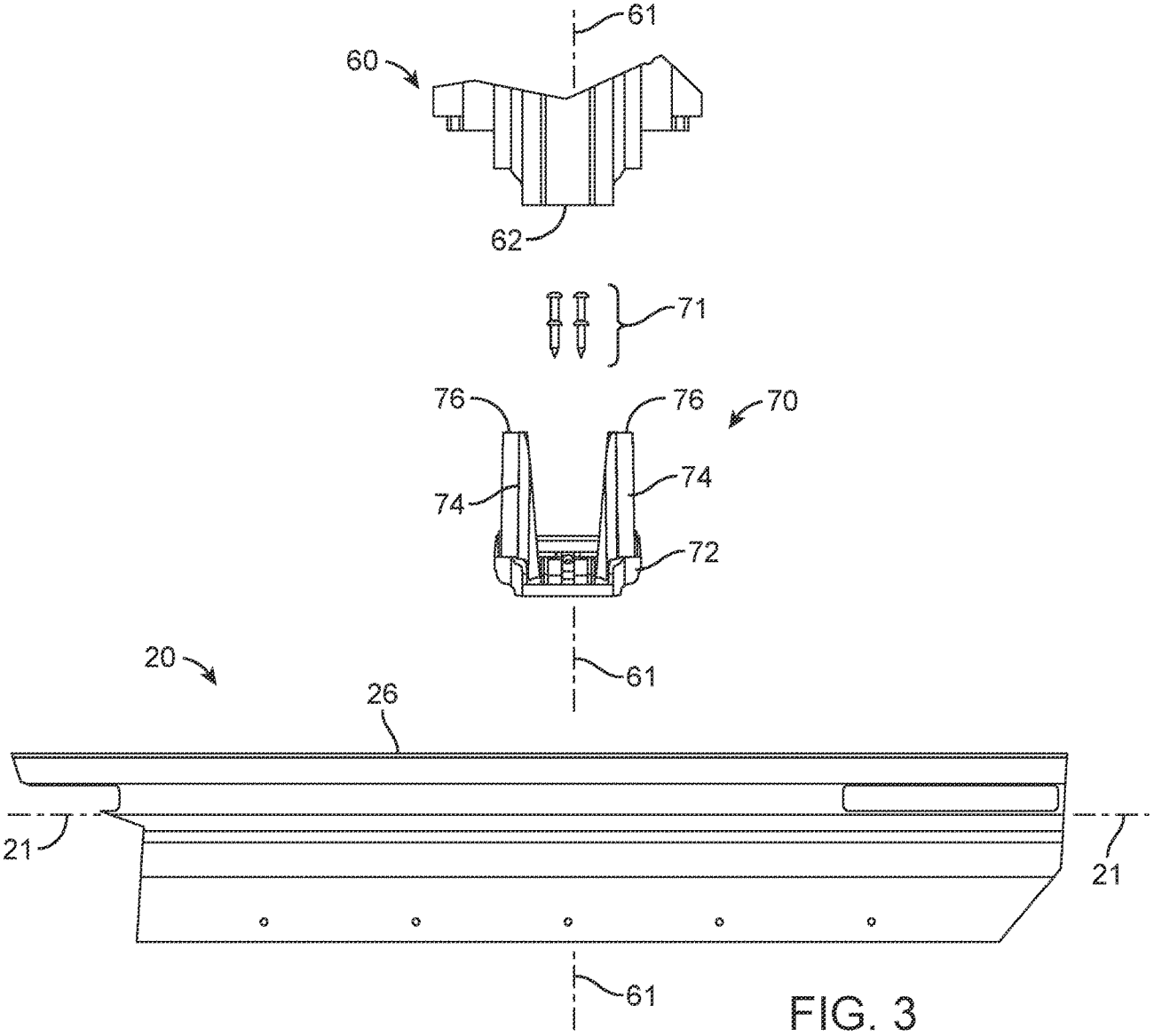
FIG. 3 is an enlarged exploded view of a portion of the fenestration unit frame depicted in FIG. 2.

FIGS. 3-4 depict front and side views of the components found at the sill end 62 of the intermediate jamb 60 where the sill end 62 of the intermediate jamb 60 connects or is attached to the sill jamb 20. In particular, FIG. 4 may be described as an end view taken along the direction of sill axis 21 in FIG. 3.

In particular, features of the illustrative embodiment of sill key 70 are seen in FIGS. 3-4. Sill key 70, in the depicted illustrative embodiment, includes a base 72 configured to be attached to the sill jamb 20. As seen in, e.g., FIG. 4, the base 72 of sill key 70 may include a profile or shape that is complementary to the shape of the sill jamb 20 to facilitate a strong and weatherproof connection between the base 72 of sill key 70 and sill jamb 20. In one or more embodiments, adhesives and/or sealants may be used to further provide a strong and/or weatherproof connection between the base 72 of sill key 70 and sill jamb 20. In the depicted illustrative embodiment, threaded fasteners 71 may also be used to attach sill key 70 to sill jamb 20.

The depicted illustrative embodiment of sill key 70 includes a pair of sill key posts 74 that extend away from the sill key base 72 in the direction of the intermediate jamb axis 61. The sill key posts 74 extend away from the sill key base 72 and terminate at sill post ends 76. Although the depicted illustrative embodiment of sill key 70 includes two sill key posts 74, alternative embodiments of sill keys used in fenestration unit frames as described herein may include as few as one sill key post or may include three or more sill key posts. Furthermore, although the sill key posts 74 depicted in the illustrative embodiment of sill key 70 are similar in shape (although mirror images of each other), sill keys including multiple sill key posts as described herein may include sill key posts that have different shapes and configurations.

As will be described further herein, the sill key posts 74 may preferably extend into sill end cavities in the sill end 62 of the intermediate jamb 60. That interaction between sill key posts 74 and sill end cavities in the intermediate jamb 60 assist in retaining the intermediate jamb 60 in position between the sill jamb 20 and the head jamb 30, as well as guiding the sill end 62 of intermediate jamb 60 into its proper position with respect to sill jamb 20 and, in one or more embodiments, may also provide additional structural rigidity to the connection between intermediate jamb 60 and sill jamb 20 when fully assembled into a fenestration unit frame.

Also depicted in FIG. 4 are features that form one illustrative embodiment of an interlocking sill connection that prevents movement of the sill end 62 of the intermediate jamb 60 relative to the sill jamb 20 in a direction transverse to both the sill axis 21 and the intermediate jamb axis 61 (which, in FIG. 3, would involve movement of the sill end 62 of intermediate jamb 60 into or out of the page containing FIG. 3). In the depicted illustrative embodiment those features include a sill rail 26 having a sill rail top 28 formed in sill jamb 20 and a channel 66 formed in the sill end 62 of intermediate jamb 60 that is configured to receive the sill rail 26 to form the interlocking connection as described herein.

Figure 5:
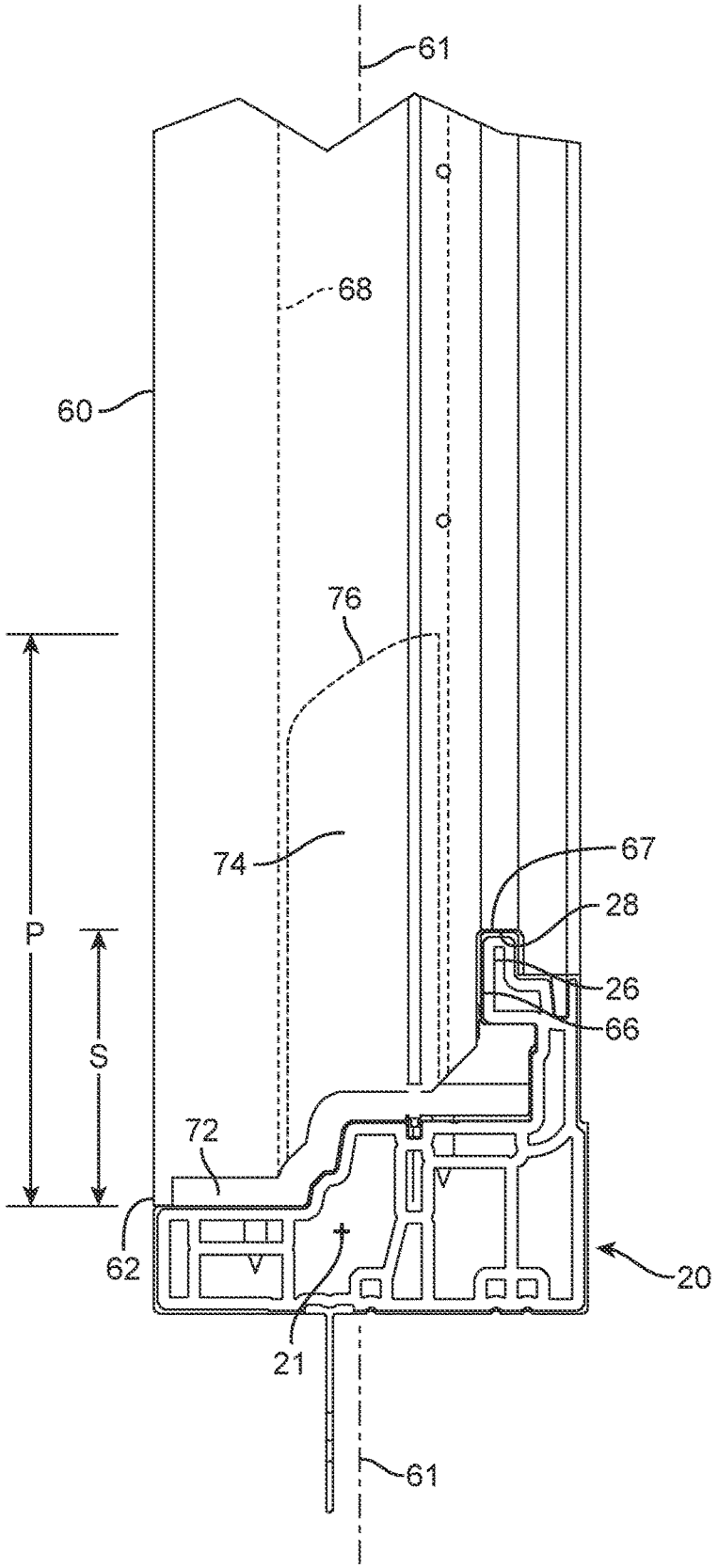
FIG. 5 is an enlarged end view of the assembly depicted in FIGS. 3-4 after assembly of the components.

FIG. 5 depicts the components of FIGS. 3-4 after assembly such that the sill key 70 is attached to sill jamb 20 and sill end 62 of intermediate jamb 60 is seated against the sill key 70 and sill jamb 20. An additional feature depicted in broken lines because it is not visible in the view seen in FIG. 5 is a sill end cavity 68 formed in intermediate jamb 60 into which sill key post 74 (also depicted in broken lines) is inserted as a part of the assembly process. In one or more embodiments in which the intermediate jamb is formed as an extruded member, sill end cavity 68 may extend along the entire length of intermediate jamb 60 between the sill end 62 and the head end 64. This feature is not, however, required, and the sill end cavity 68 may be separate and distinct from a head end cavity at the head end of the intermediate jamb 60.

When assembled, the optional interlocking connection formed between sill end 62 of intermediate jamb 60 and sill jamb 20 involves positioning of sill rail 26 in channel 66 in the sill end 62 of intermediate jamb 60. Because of this interlocking connection, sill end 62 of intermediate jamb 60 must be moved into position on sill jamb 20 along intermediate jamb axis 61 during assembly of the fenestration unit frame before the ends of the jambs are assembled and connected at the corner joints. Sill key post 74 and sill end cavity 68 assist in both retention and proper alignment of the sill end 62 of intermediate jamb 60 during that assembly process because sill key post 74 is positioned in sill end cavity 68 before sill rail 26 is positioned in channel 66 to form the interlocking connection between the sill end 62 of intermediate jamb 60 and sill jamb 20. Further, sill key post 74 extends along the direction of intermediate jamb axis 61.

In one or more embodiments, the interlocking sill connection formed between sill jamb 20 and intermediate jamb 60 may define an interlocking sill connection distance S measured along the intermediate jamb axis 61 between the sill end 62 and the sill rail top 28 on sill rail 26 as seen in FIG. 5. The sill key post 74 may be described as extending into the sill end cavity 68 over a post-cavity distance P measured along the intermediate jamb axis 61 between the sill end 62 and the sill post end 76. In one or more embodiments, the post-cavity distance P is greater than the interlocking sill connection distance S.

Another manner in which the junction between sill end 62 of intermediate jamb 60, sill key 70, and sill jamb 20 may be characterized is in the position of various features of those components. In particular, in one or more embodiments, the interlocking sill connection may be described as having a terminal junction defined by the sill rail top 28 of sill rail 26 and the terminal end 67 of channel 66 in sill end 62 of intermediate jamb 60. That terminal junction between sill rail top 28 and terminal end 67 of channel 66 may be described as being distal from the sill jamb 20 along the intermediate jamb axis 61. Further, the terminal junction between sill rail top 28 and terminal end 67 of channel 66 may be described as being located between the sill key base 72 and the sill post end 76 along the intermediate jamb axis 61. One embodiment of this arrangement of features is seen in, e.g., FIG. 5.

In one or more embodiments of fenestration unit frames as described herein, the sill rail 26 of sill jamb 20 may extend along the entire length of the sill jamb 20 from its first end 22 to its second end 24. Providing a sill rail 26 that extends along the sill jamb 20 provides flexibility in location of the intermediate jamb 60 at any position along sill jamb 20 as needed. Furthermore, in embodiments in which sill jamb 20 is an extruded member, providing a sill rail 26 that extends along the entire length of the sill jamb 20 simplifies the process of manufacturing sill jamb 20.

Figure 6:
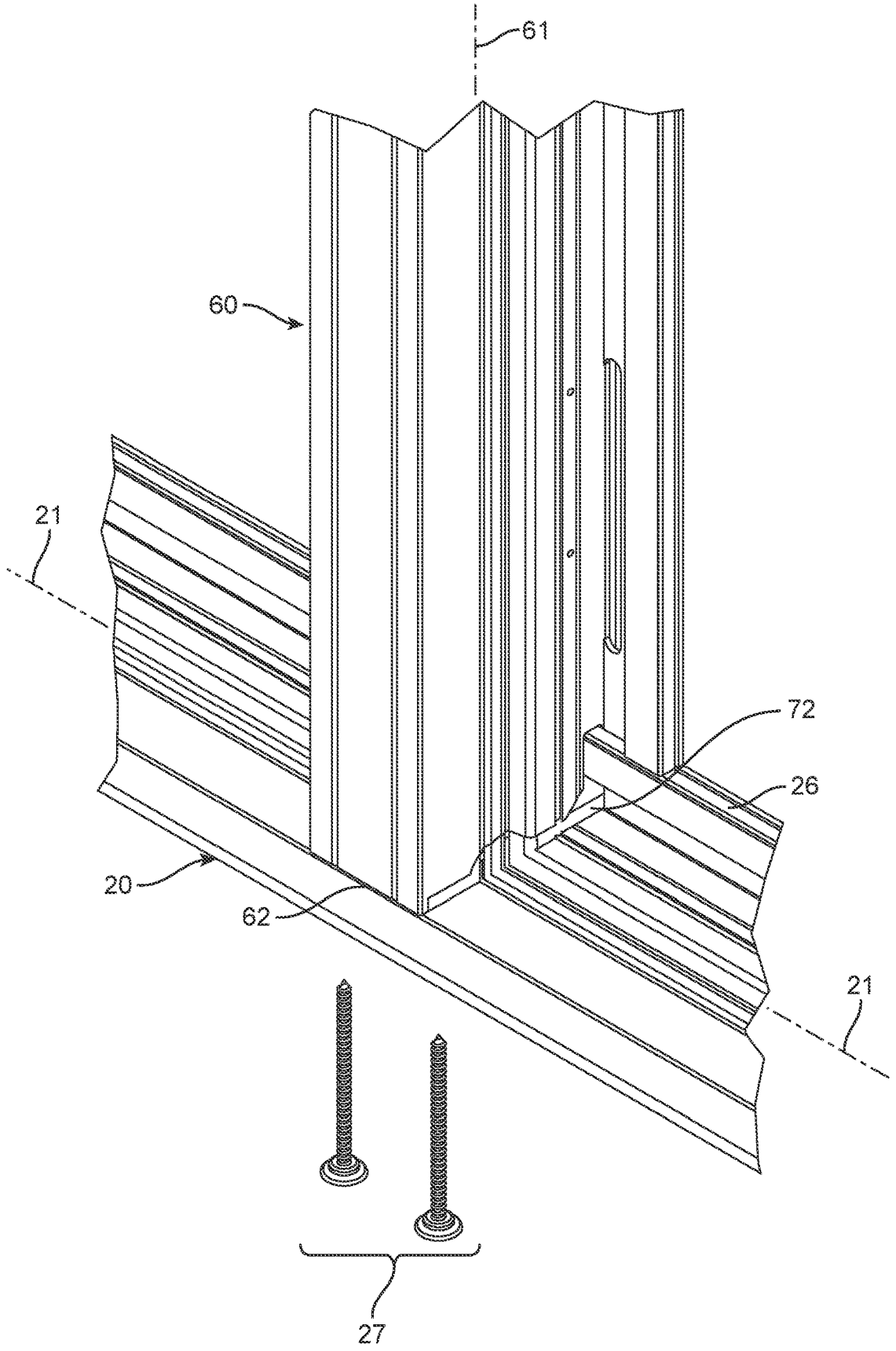
FIG. 6 is a perspective view of the mull post and sill jamb of FIG. 5 as assembled.

FIG. 6 depicts the joint formed by the sill end 62 of intermediate jamb 60 with sill jamb 20. In the depicted illustrative embodiment, a portion of the base 72 of sill key 70 may be visible in the finished joint, although that is not necessarily true in all embodiments. Also seen in FIG. 6 is sill rail 26 that extends along the length of sill jamb 20. Further seen in FIG. 6 are threaded fasteners 27 that may optionally be used to secure the sill end 62 of intermediate jamb 60 to sill jamb 20 after assembly of the fenestration unit frame.

Although the discussion regarding the connection of intermediate jamb 60 within the fenestration unit frame and FIGS. 3-6 has focused on the connection between the sill end 62 of intermediate jamb 60 with sill jamb 20, it should be understood that, in one or more embodiments, the connection between the head end 64 of intermediate jamb with head jamb 30 using head key 80 (as seen in, e.g., FIG. 2) includes the same features and relationships. For example, head jamb 30 includes head rail having a head rail top similar to that depicted in connection with sill jamb 20 while the head key 80 includes head key posts extending from a head key base along the intermediate jamb axis 61 as described in connection with the sill key 70. Further, the relationships between various features forming the optional interlocking sill connection are also, in one or more embodiments, replicated in an optional interlocking head connection at the junction between the head end 64 of intermediate jamb 60 and head jamb 30. The similarities between the connection at the head and of the intermediate jamb and the head jamb to the sill end of the intermediate jamb and the sill jamb are illustrated below in connection with FIGS. 7-12, where the focus of FIGS. 9-12 is on that head end connection.

Figure 7:
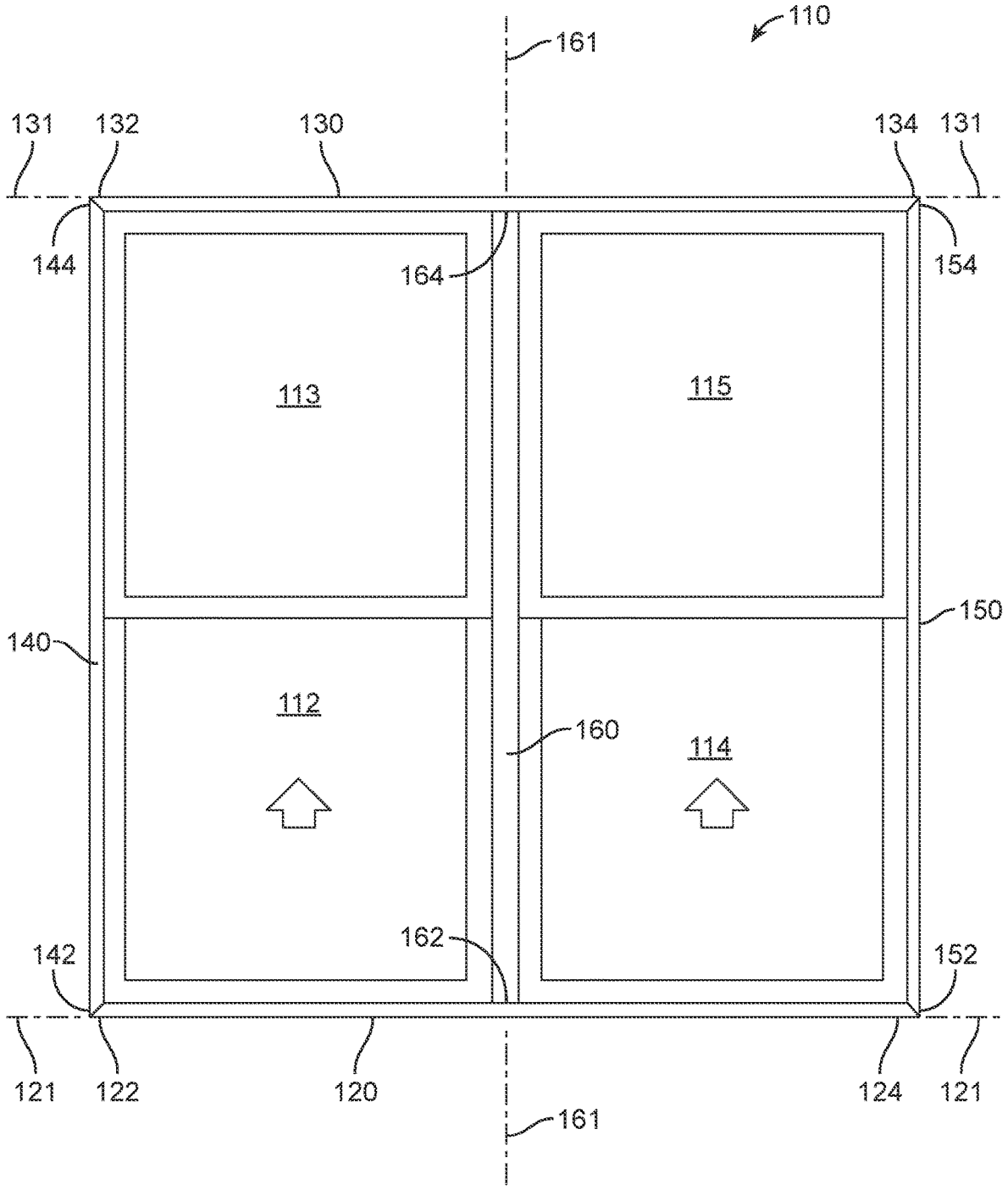
FIG. 7 depicts one illustrative embodiment of a fenestration unit in the form of a twin single hung window having a fenestration unit frame including an integral mull post.

FIG. 7 depicts an illustrative embodiment of a fenestration unit 110 in the form of a twin single hung window. The fenestration unit 110 includes a fenestration unit frame with an integral mull post in the form of an intermediate jamb 160. Other components of the fenestration unit frame include a sill jamb 120, head jamb 130, left side jamb 140, and right side jamb 150. The intermediate jamb 160 extends between the sill jamb 120 and head jamb 130 and is located between the left side jamb 140 and right side jamb 150. Single hung windows are provided on opposite sides of the intermediate jamb 160. In particular, the left side single hung window includes a lower sash 112 and an upper sash 113, while the right side single hung window includes a lower sash 114 and upper sash 115.

Sill jamb 120 as seen in FIG. 7 extends along a sill axis 121 between a first end 122 and a second end 124. Similarly, head jamb 130 extends along a head axis 131 between a first end 132 and a second end 134.

Left side jamb 140 extends between the first end 122 of sill jamb 120 and the first end 132 of head jamb 130. In the depicted illustrative embodiment, a sill corner joint connects the first end 142 of left side jamb 140 to the first end 122 of sill jamb 120 and a head corner joint connects the first end 132 of head jamb 132 the second end 144 of left side jamb 140. In one or more embodiments, the sill corner joint and the head corner joint may be welded joints that may or may not include a corner key to assist in positioning and/or provide additional rigidity to the corner joints formed between the sill jamb 120, head jamb 130, and left side jamb 140.

Right side jamb 150 extends between the second end 124 of sill jamb 120 and the second end 134 of head jamb 130. In the depicted illustrative embodiment, a sill corner joint connects the first end 152 of the right side jamb 150 to the second end 124 of the sill jamb 120 and a head corner joint connects the second end 134 of head jamb 132 the second end 154 of the right side jamb 150. As discussed above, the sill corner joint and the head corner joint formed on the right side of the fenestration unit frame may, in one or more embodiments, may or may not include a corner key to assist in positioning and/or to provide additional rigidity to the corner joints formed between the sill jamb 120, head jamb 130, and right side jamb 150.

Figure 8:
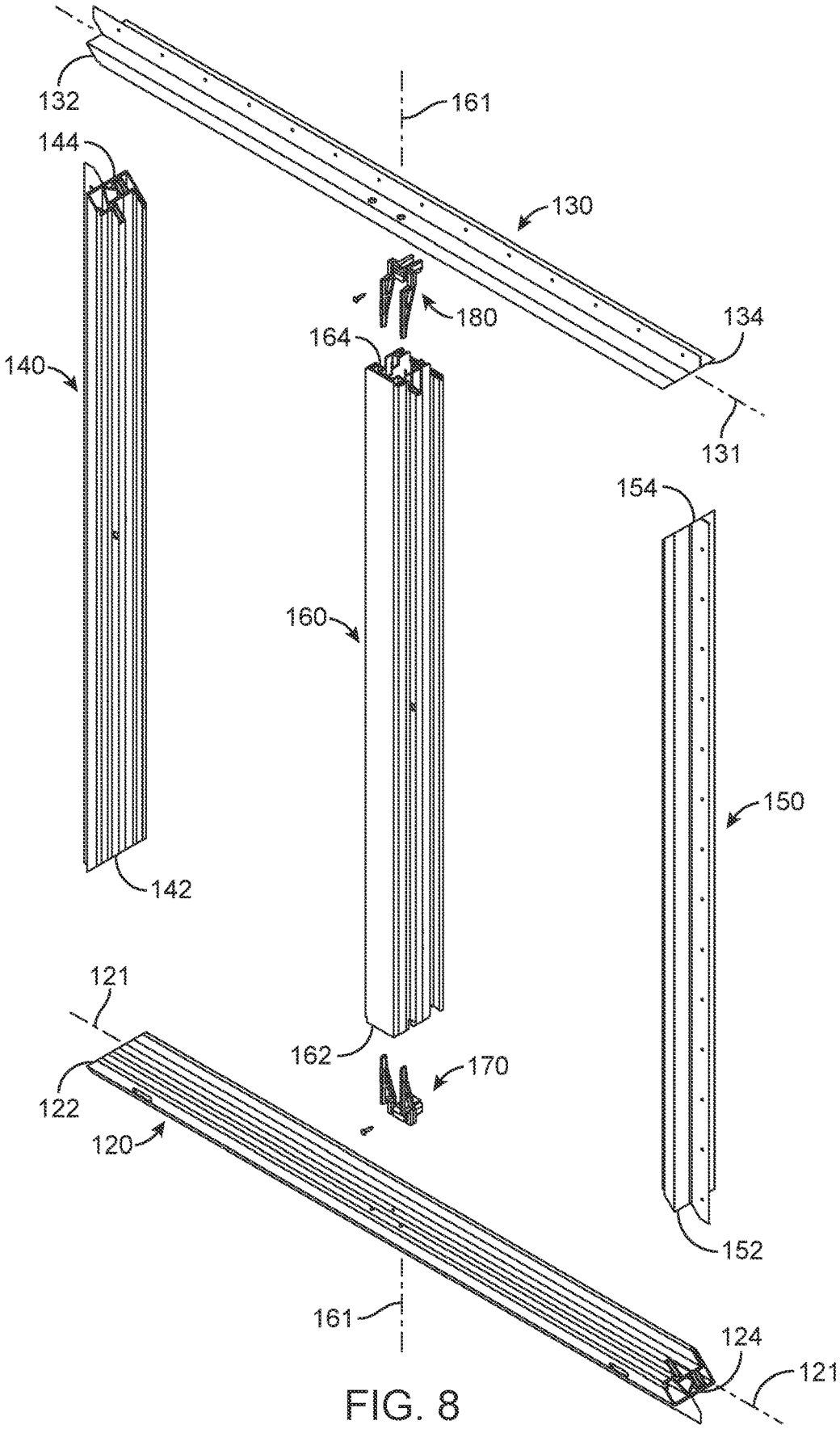
FIG. 8 is an exploded assembly diagram of the fenestration unit frame of the fenestration unit depicted in FIG. 7.

FIG. 8 is an exploded assembly diagram of the fenestration unit frame used in fenestration unit 110 as depicted in FIG. 7. In addition to the components and features described in FIG. 7, the exploded assembly diagram of FIG. 8 depicts, more clearly, various features regarding the intermediate jamb 160 provided as a part of the fenestration unit frame.

In the depicted illustrative embodiment, the intermediate jamb 160 extends along an intermediate jamb axis 161 between the sill jamb 120 and the head jamb 130 at a location between the left side jamb 140 and the right side jamb 150. A sill end 162 of the intermediate jamb 160 and the sill jamb 120 form an interlocking sill connection that prevents movement of the sill end 162 of the intermediate jamb 160 relative to the sill jamb 120 in a direction transverse to both the sill axis 121 and the intermediate jamb axis 161. A head end 164 of the intermediate jamb 160 and the head jamb 130 form an optional interlocking head connection that prevents movement of the head end 164 of the intermediate jamb 160 relative to the head jamb 130 in a direction transverse to both the head axis 131 and the intermediate jamb axis 161.

Attachment and fixation of the intermediate jamb 160 at selected locations along both the sill jamb 120 and the head jamb 130 are, in the depicted embodiment, accomplished using keys attached to the sill jamb 120 and the head jamb 130. In particular, a sill key 170 is attached to the sill jamb 120 and a sill key 180 is attached to the head jamb 130. In the depicted illustrative embodiment, the sill key 170 is attached to the sill jamb 120 and the head key 180 is attached to the head jamb 130 using threaded fasteners, although any suitable fastening technique or combination of techniques could be used in place of and/or in addition to threaded fasteners (e.g., adhesives, welding, rivets, etc.).

In the depicted illustrative embodiment, the fenestration unit frame members, i.e., sill jamb 120, head jamb 130, side jambs 140 and 150, each include mitered ends configured to mate with each other at the corner joints of the fenestration unit frame. As discussed herein, the corner joints may or may not include corner keys.

Figure 10:
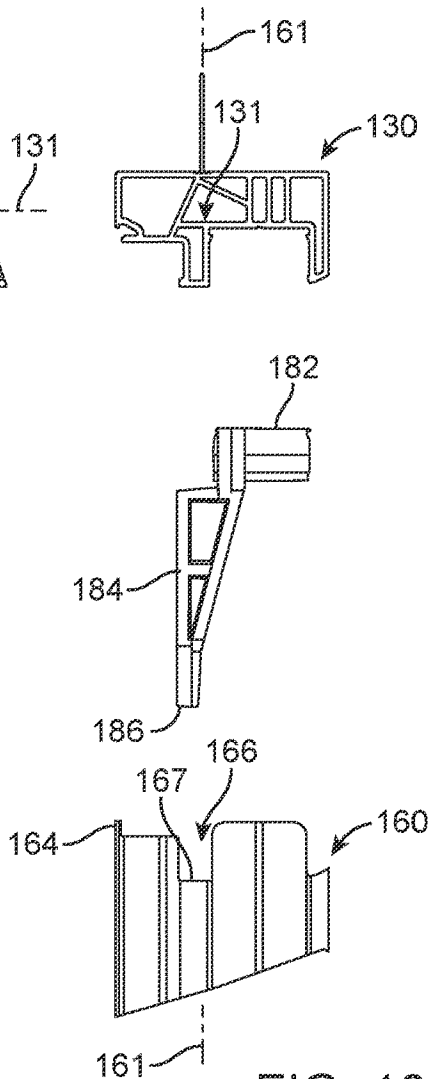
FIG. 10 is a side view of the enlarged exploded view of FIG. 9.
Figure 9:
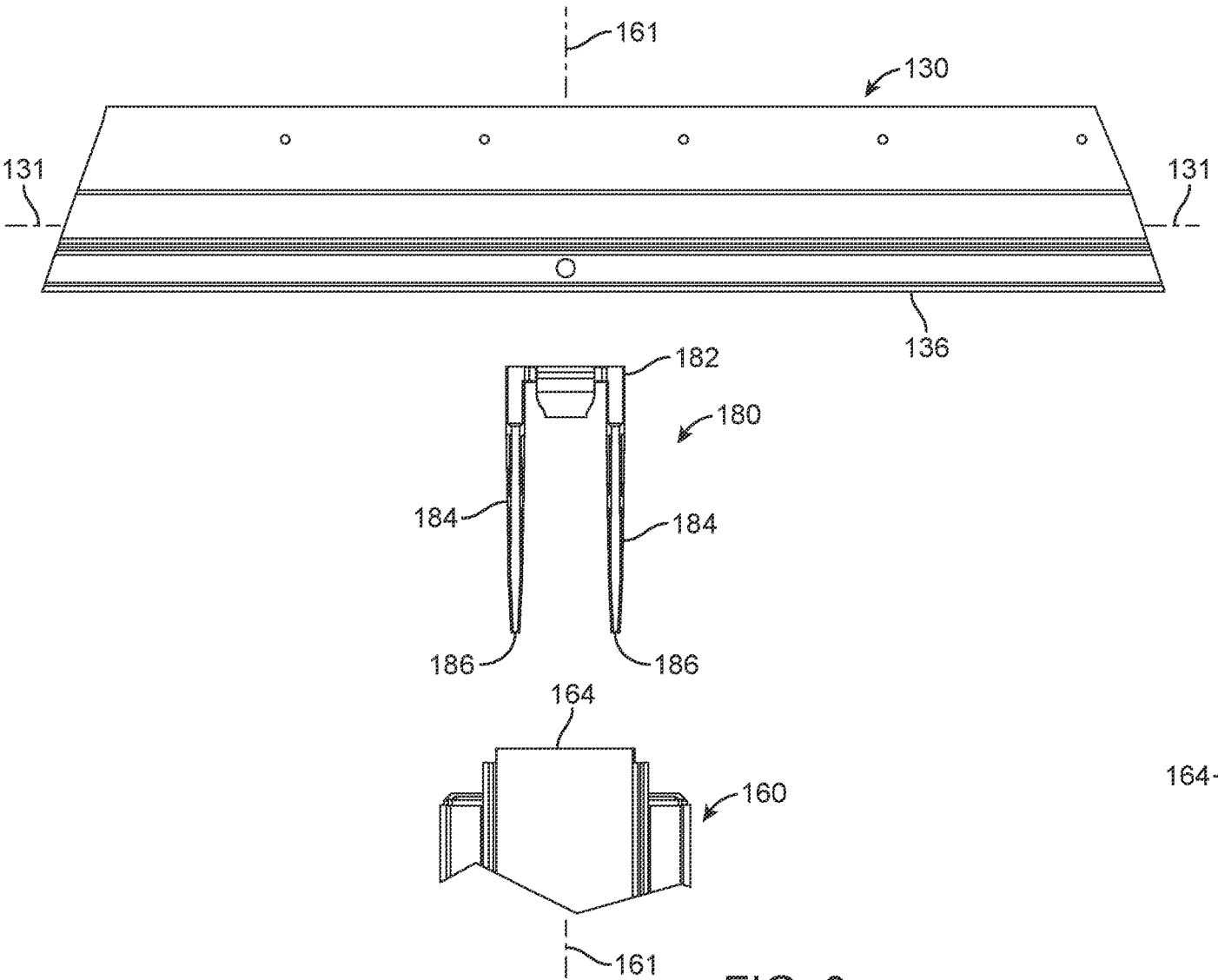
FIG. 9 is an enlarged exploded view of a portion of the fenestration unit frame depicted in FIG. 8.

FIGS. 9-10 depicted front and side views of the components found at the head end 164 of the intermediate jamb 160 where the head end 164 of the intermediate jamb 160 connects or is attached to the head jamb 130. In particular, FIG. 10 may be described as an end view taken along the direction of head axis 131 in FIG. 9.

In particular, features of the illustrative embodiment of head key 180 are seen in FIGS. 9-10. Head key 180, in the depicted illustrative embodiment, includes a base 182 configured to be attached to the head jamb 130. As seen in, e.g., FIG. 10, the base 182 of sill key 180 may include a profile or shape that is complementary to the shape of the head jamb 132 facilitate a strong and weatherproof connection between the base 182 of head key 180 and the head jamb 130. In one or more embodiments, adhesives and/or sealants may be used to further provide a strong and/or weatherproof connection between the base 182 of the head key 180 and the head jamb 130. Threaded fasteners may also be used to attach head key 182 head jamb 130.

The depicted illustrative embodiment of head key 180 includes a pair of head key posts 184 that extend away from the head key base 182 in the direction of the intermediate jamb axis 161. The head key posts 184 extend away from the head key base 182 and terminate at sill Post ends 186. Although the depicted illustrative embodiment of head key 180 includes two head key posts 184, alternative embodiments of head keys used in fenestration unit frames as described herein may include as few as one head key post or may include three or more head key posts. Furthermore, although the head key posts 184 depicted in the illustrative embodiment of head key 180 are similar in shape (although mirror images of each other), head keys including multiple head key posts as described herein may include head key posts that have different shapes and configurations.

As will be described further herein, the head key posts 184 may preferably extend into head end cavities in the head end 164 of the intermediate jamb 160. That interaction between head key posts 184 and head end cavities in the intermediate jamb 160 assist in retaining the intermediate jamb 160 in position between the sill jamb 120 and the head jamb 130, as well as guiding the head end 164 of intermediate jamb 160 into its proper position with respect to head jamb 130 and, in one or more embodiments, may also provide additional structural rigidity to the connection between intermediate jamb 160 and head jamb 131 fully assembled into a fenestration unit frame.

Also depicted in FIG. 10 are features that form one illustrative embodiment of an interlocking head connection that prevents movement of the head end 164 of the intermediate jamb 160 relative to the head jamb 130 in a direction transverse to both the head axis 131 and the intermediate jamb axis 161 (which, in FIG. 9, would involve movement of the head end 164 of intermediate jamb 160 into or out of the page containing FIG. 9). In the depicted illustrative embodiment, those features include a head rail 136 having a head rail top 138 formed in head jamb 130 and a channel 166 formed in the head end 164 of intermediate jamb 160 that is configured to receive the head rail 136 to form the interlocking connection as described herein.

Figure 11:
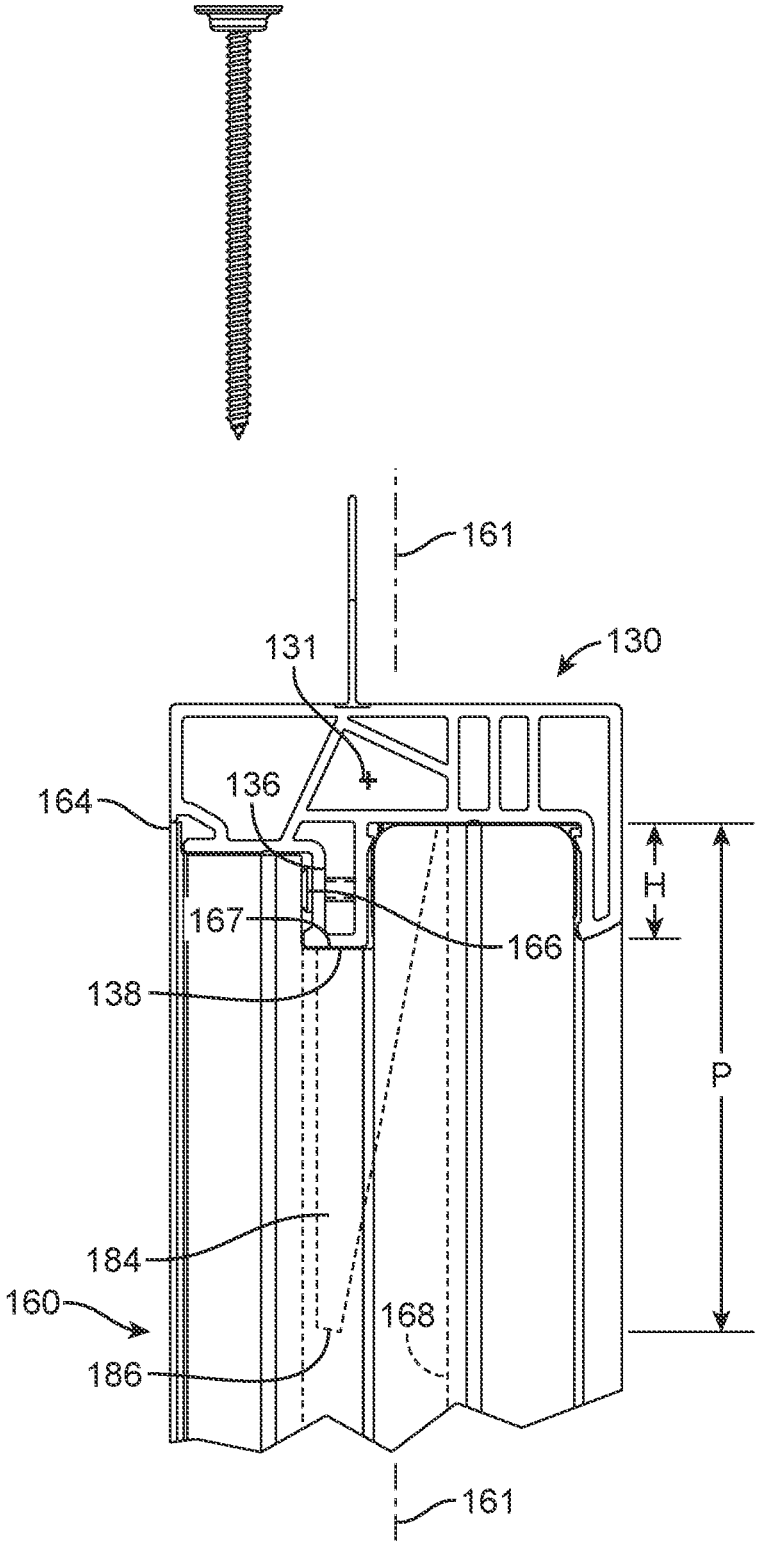
FIG. 11 is an enlarged end view of the assembly depicted in FIGS. 9-10 after assembly of the components.

FIG. 11 depicts the components of FIGS. 9-10 after assembly such that the head key 180 is attached to the head jamb 130 and head end 164 of intermediate jamb 160 is seated against the head key 180 and head jamb 130. An additional feature depicted in broken lines because it is not visible in the view seen in FIG. 11 is a head end cavity 168 formed in intermediate jamb 160 into which head key post 184 (also depicted in broken lines in FIG. 11) is inserted as a part of the assembly process. In one or more embodiments in which the intermediate jamb 160 is formed as an extruded member, head end cavity 168 may extend along the entire length of intermediate jamb 160 between the sill end 162 and the head end 164. This feature is not, however, required and the head end cavity 168 may be separate and distinct from a sill end cavity at the sill end 162 of the intermediate jamb 160.

When assembled, the optional interlocking connection formed between head end 164 of intermediate jamb 160 and head jamb 130 involves positioning of head rail 136 and channel 166 in the head end 164 of intermediate jamb 160. Because of this interlocking connection, the head end 164 of intermediate jamb 160 must be moved into position on head jamb 130 along intermediate jamb axis 161 during assembly of the fenestration unit frame before the ends of the jambs are assembled and connected at the corner joints. Head key post 184 and head end cavity 168 assist in both retention and proper alignment of the head end 164 of intermediate jamb 160 during that assembly process because head key post 184 is positioned in head end cavity 168 before had rail 136 is positioned in channel 166 to form the interlocking connection between the head end 164 of intermediate jamb 160 and head jamb 130. Further, head key post 184 extends along the direction of intermediate jamb axis 161 within head end cavity 168.

In one or more embodiments, the interlocking head connection formed between head jamb 130 and intermediate jamb 160 may define an interlocking head connection distance H measured along the intermediate jamb axis 161 between the head end 164 and the head rail top 138 on head rail 136 as seen in FIG. 11. The head key post 184 may be described as extending into the head end cavity 168 over a post-cavity distance P measured along the intermediate jamb axis 161 between the head end 164 and the head post end 186 of head key post 184. In one or more embodiments, the post-cavity distance P is greater than the interlocking head connection distance H.

Another manner in which the junction between the head end 164 of intermediate jamb 160, head key 180, and head jamb 130 may be characterized is in the position of various features of those components. In particular, in one or more embodiments, the interlocking head connection may be described as having a terminal junction defined by the head rail top 138 of head rail 136 and the terminal end 167 of channel 166 in head end 164 of intermediate jamb 160. That terminal junction between head rail top 138 and terminal end 167 of channel 166 may be described as being distal from the head jamb 130 along the intermediate jamb axis 161. Further, the terminal junction between head rail top 138 and terminal end 167 of channel 166 may be described as being located between the head key base 182 and the head post end 186 along the intermediate jamb axis 161 one embodiment of this arrangement of features is seen in, e.g., FIG. 11.

In one or more embodiments of fenestration unit frames as described herein, the head rail 136 of head jamb 130 may extend along the entire length of the head jamb 130 from its first end 132 to its second end 134. Providing a head rail 136 that extends along the head jamb provides flexibility and location of the intermediate jamb 160 at any position along head jamb 130 as needed. Furthermore, in embodiments in which head jamb 130 is an extruded member, providing a head rail 136 that extends along the entire length of the head jamb 130 may simplify the process of manufacturing head jamb 130.

Figure 12:
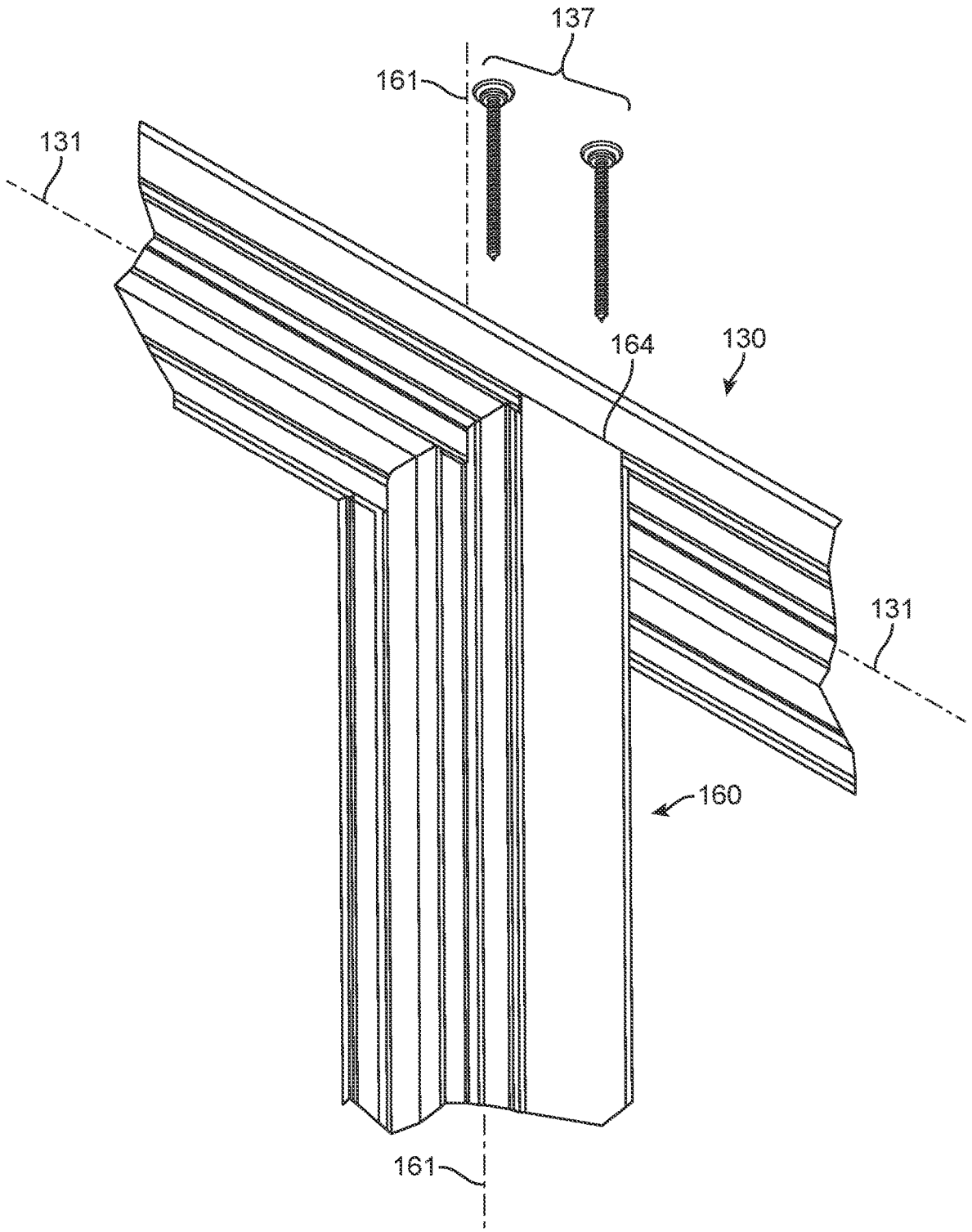
FIG. 12 is a perspective view of the mull post and sill jamb of FIG. 11 as assembled.

FIG. 12 depicts the joint formed by the head end 164 of intermediate jamb 160 with head jamb 130. Threaded fasteners 137 are depicted in FIG. 12 and may optionally be used to secure the head end 164 of intermediate jamb 160 to head jamb 130 during assembly of the fenestration unit frame.

Figure 13:
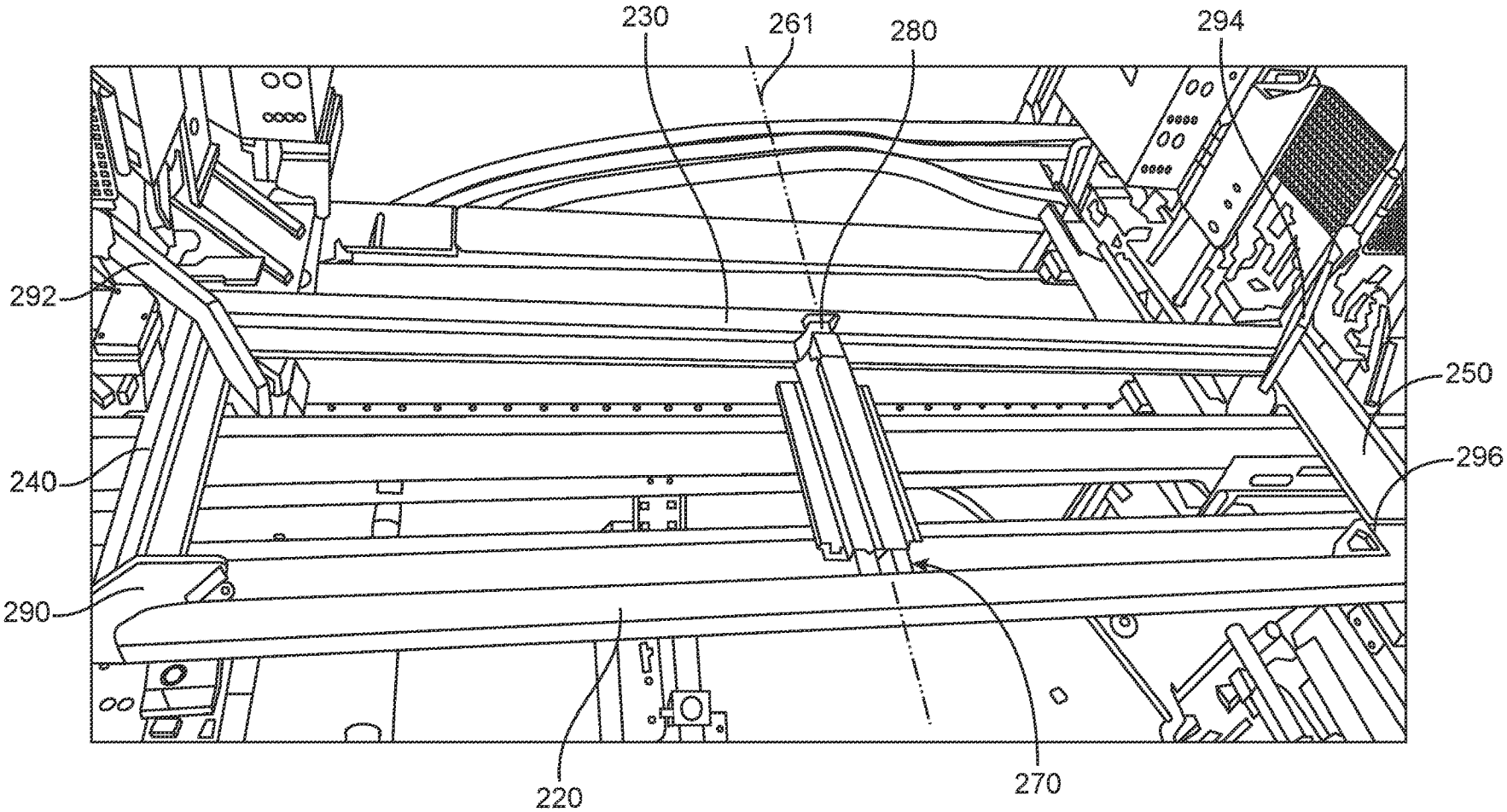
FIG. 13 is a perspective view of another illustrative embodiment of a fenestration unit frame including an integral mull post during assembly of the components as described herein.

FIG. 13 is a perspective view of another illustrative embodiment of a fenestration unit frame including an integral mull post during assembly of the components as described herein. In particular, the fenestration unit frame includes a sill jamb 220, head jamb 230, left side jamb 240, and right side jamb 250. At the corners of the fenestration unit frame, a series of connection tools 290, 292, 294, 296 are positioned between the mitered ends of the jamb components to connect the ends of the jambs with each other at the corners of the fenestration unit frame.

In one or more embodiments, the tools 290, 292, 294, 296 may be in the form of heated members used to supply thermal energy to weld the ends of the jambs at the corner joints, adhesive applicators to supply adhesive to connect the ends of the jambs at the corner joints, etc. In other embodiments, tools 290, 292, 294, 296 may be measuring plates used in the manufacturing of custom-sized fenestration unit frames, with the measuring plates 290, 292, 294, 296 being replaced by tools configured to connect the ends of the jambs together at the corner joints using, e.g., thermal energy, adhesives, mechanical connectors, etc.

An intermediate jamb 260 is depicted as being connected within the frame between sill jamb 220 and head jamb 230, with retention and alignment of the intermediate jamb 260 being assisted before the corner joints are fully assembled and completed by sill key 270 and head key 280. That alignment is possible because the posts of the sill key 270 and head key 280 are partially inserted into cavities in the opposing ends of the intermediate jamb 260.

In one or more embodiments, the methods of manufacturing a fenestration unit frame such as that depicted in, e.g., FIG. 13 may include attaching the sill key 270 to the sill jamb 230 at an intermediate location between the ends of the sill jamb 220. The method may further include attaching the head key 280 to the head jamb 230 at an intermediate location between the ends of the head jamb 230. The method may further include positioning the side jambs between the ends of the sill jamb and the head jamb as seen in, e.g., FIG. 13. The intermediate jamb 260 may be positioned between the sill jamb 220 and the head jamb 230 and may further involve inserting a portion of a sill key post of sill key 270 into a sill end cavity in the sill end of the intermediate jamb 260 after the sill key 270 has been attached to the sill jamb 220. Similarly, the method may further involve inserting a portion of a head key post of head key 280 into a head end cavity in the head end of the intermediate jamb 260 after the head key has been attached to the head jamb 220.

With the components thus situated, the ends of the sill jamb and head jamb as well as the ends of the side jambs may be welded or otherwise connected to each other after the sill key post and head key post have been at least partially inserted into their respective end cavities in intermediate jamb 260.

The assembly process may further involve optionally forming an interlocking sill connection between the sill end of the intermediate jamb 260 and the sill jamb 220 by moving the sill jamb 220 and intermediate jamb 260 toward each other along the intermediate jamb axis 261. In addition, the assembly process may further involve forming an interlocking head connection between the head end of the intermediate jamb 260 and the head jamb 230 by moving the head jamb 230 and intermediate jamb 260 toward each other along the intermediate jamb axis 261.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the fenestration unit frames with integral mull posts and methods of making the same are discussed herein some possible variations have been described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A fenestration unit frame comprising:

a sill jamb extending along a sill axis between a first end and a second end;

a head jamb extending along a head axis between a first end and a second end;

a first side jamb extending between the first end of the sill jamb and the first end of the head jamb, wherein a first sill corner joint connects the first side jamb to the first end of the sill jamb and a first head corner joint connects the first side jamb to the first end of the head jamb;

a second side jamb extending between the second end of the sill jamb and the second end of the head jamb, wherein a second sill corner joint connects the second side jamb to the second end of the sill jamb and a second head corner joint connects the second side jamb to the second end of the head jamb;

an intermediate jamb extending along an intermediate jamb axis between the sill jamb and the head jamb at a location between the first side jamb and the second side jamb, wherein a sill end of the intermediate jamb and the sill jamb form an interlocking sill connection that prevents movement of the sill end relative to the sill jamb in a direction transverse to both the sill axis and the intermediate jamb axis, and wherein a head end of the intermediate jamb and the head jamb form an interlocking head connection that prevents movement of the head end relative to the head jamb in a direction transverse to both the head axis and the intermediate jamb axis;

a sill key attached to the sill jamb, wherein the sill key comprises a sill key base proximate the sill and a sill key post extending away from the sill key base along the intermediate jamb axis, wherein the sill key post extends into a sill end cavity in the sill end of the intermediate jamb; and a head key attached to the head jamb, wherein the head key comprises a head key base proximate the head and a head key post extending away from the head key base along the intermediate jamb axis, wherein the head key post extends into a head end cavity in the head end of the intermediate jamb.

2. A fenestration unit frame according to claim 1, wherein the interlocking sill connection defines an interlocking sill connection distance measured along the intermediate jamb axis and wherein the sill key post extends into the sill end cavity over a post-cavity distance that is greater than the interlocking sill connection distance.

3. A fenestration unit frame according to claim 2, wherein the interlocking head connection defines an interlocking head connection distance measured along the intermediate jamb axis and wherein the head key post extends into the head end cavity over a post-cavity distance that is greater than the interlocking head connection distance.

4. A fenestration unit according to claim 1, wherein the sill key post comprises a sill post end distal from the sill along the intermediate jamb axis, and wherein the interlocking sill connection comprises a terminal junction distal from the sill jamb along the intermediate jamb axis, and further wherein the terminal junction of the interlocking sill connection is located between the sill key base and the sill post end.

5. A fenestration unit according to claim 1, wherein the head key post comprises a head post end distal from the head along the intermediate jamb axis, and wherein the interlocking head connection comprises a terminal junction distal from the head jamb along the intermediate jamb axis, and further wherein the terminal junction of the interlocking head connection is located between the head key base and the head post end.

6. A fenestration unit frame according to claim 1, wherein the sill key post comprises a first sill key post, and wherein the sill key comprises a second sill key post extending away from the sill key base along the intermediate jamb axis, wherein the second sill key post extends into a second sill end cavity in the sill end of the intermediate jamb.

7. A fenestration unit frame according to claim 1, wherein the head key post comprises a first head key post, and wherein the head key comprises a second head key post extending away from the head key base along the intermediate jamb axis, wherein the second head key post extends into a second head end cavity in the head end of the intermediate jamb.

8. A fenestration unit frame according to claim 1, wherein the interlocking sill connection comprises a sill rail, and wherein the sill end of the intermediate jamb comprises a channel configured to receive the sill rail to form the interlocking connection.

9. A fenestration unit frame according to claim 8, wherein the sill rail extends along the entire length of the sill jamb from the first end to the second end of the sill jamb.

10. A fenestration unit frame according to claim 8, wherein the sill rail comprises a sill rail top and wherein the sill key post comprises a sill post end distal from the sill along the intermediate jamb axis, and wherein the sill rail top is located between the sill key base and the sill post end.

11. A fenestration unit frame according to claim 1, wherein the interlocking head connection comprises a head rail, and wherein the head end of the intermediate jamb comprises a channel configured to receive the head rail to form the interlocking connection.

12. A fenestration unit frame according to claim 11, wherein the head rail extends along the entire length of the head jamb from the first end to the second end of the head jamb.

13. A fenestration unit frame according to any one of claims 11 to 12, wherein the head rail comprises a head rail top and wherein the head key post comprises a head post end distal from the head along the intermediate jamb axis, and wherein the head rail top is located between the head key base and the head post end.

14. A fenestration unit frame according to claim 1, wherein the first sill corner joint and the first head corner joint comprise welded corner joints.

15. A method of manufacturing a fenestration unit frame that comprises a sill jamb, a head jamb, a first side jamb, a second side jamb, and an intermediate jamb, the method comprising:

attaching a sill key to the sill jamb at an intermediate location between a first end and a second end of the sill jamb, wherein the sill key comprises a sill key base proximate the sill and a sill key post extending away from the sill key base along the intermediate jamb axis;

attaching a head key to the head jamb at an intermediate location between a first end and a second end of the head jamb, wherein the head key comprises a head key base proximate the head and a head key post extending away from the head key base along the intermediate jamb axis;

positioning the first side jamb between the first end of the sill jamb and the first end of the head jamb;

positioning the second side jamb between the second end of the sill jamb and the second end of the head jamb;

positioning the intermediate jamb between the sill jamb and the head jamb at a location between the first side jamb and the second side jamb, wherein an intermediate jamb axis extends along the intermediate jamb between a sill end proximate the sill jamb and a head end proximate the head jamb;

inserting a portion of the sill key post into a sill end cavity in the sill end of the intermediate jamb after attaching the sill key to the sill jamb and after positioning the intermediate jamb between the sill jamb and the head jamb;

inserting a portion of the head key post into a head end cavity in the head end of the intermediate jamb after attaching the head key to the head jamb and after positioning the intermediate jamb between the sill jamb and the head jamb;

connecting the first end of the sill jamb and the first end of the head jamb to opposite ends of the first side jamb to form corner joints at the opposite ends of the first side jamb after inserting the portion of the sill key post into the sill end cavity in the sill end of the intermediate jamb and after inserting the portion of the head key post into the head end cavity in the head end of the intermediate jamb;

connecting the second end of the sill jamb and the second end of the head jamb to opposite ends of the second side jamb to form corner joints at the opposite ends of the second side jamb after inserting the portion of the sill key post into the sill end cavity in the sill end of the intermediate jamb and after inserting the portion of the head key post into the head end cavity in the head end of the intermediate jamb;

forming an interlocking sill connection between the sill end of the intermediate jamb and the sill jamb by moving the sill jamb and the sill end of the intermediate jamb closer to each other such that the sill key post advances to a fully seated position in the sill end cavity of the intermediate jamb before forming the corner joints at the first and second ends of the sill jamb, wherein the interlocking connection between the sill end of the intermediate jamb and the sill jamb prevents movement of the sill end relative to the sill jamb in a direction transverse to both a sill axis extending between the first and second ends of the sill jamb and an intermediate jamb axis extending along the intermediate jamb between the sill jamb and the head jamb; and forming an interlocking head connection between the head end of the intermediate jamb and the head jamb by moving the head jamb and the head end of the intermediate jamb closer to each other such that the head key post advances to a fully seated position in the head end cavity of the intermediate jamb before forming the corner joints at the first and second ends of the head jamb, wherein the interlocking connection between the head end of the intermediate jamb and the head jamb prevents movement of the head end relative to the head jamb in a direction transverse to both a head axis extending between the first and second ends of the head jamb and an intermediate jamb axis extending along the intermediate jamb between the sill jamb and the head jamb.

16. A method according to claim 15, wherein the interlocking sill connection defines an interlocking sill connection distance measured along the intermediate jamb axis and wherein the sill key post extends into the sill end cavity over a post-cavity distance that is greater than the interlocking sill connection distance.

17. A method according to claim 16, wherein the interlocking head connection defines an interlocking head connection distance measured along the intermediate jamb axis and wherein the head key post extends into the head end cavity over a post-cavity distance that is greater than the interlocking head connection distance.

18. A method according to claim 15, wherein the sill key post comprises a sill post end distal from the sill along the intermediate jamb axis, and wherein the interlocking sill connection comprises a terminal junction distal from the sill jamb along the intermediate jamb axis, and further wherein the terminal junction of the interlocking sill connection is located between the sill key base and the sill post end.

19. A method according to claim 15, wherein the head key post comprises a head post end distal from the head along the intermediate jamb axis, and wherein the interlocking head connection comprises a terminal junction distal from the head jamb along the intermediate jamb axis, and further wherein the terminal junction of the interlocking head connection is located between the head key base and the head post end.

20. A method according to claim 15, wherein the sill key post comprises a first sill key post, and wherein the sill key comprises a second sill key post extending away from the sill key base along the intermediate jamb axis, wherein the second sill key post extends into a second sill end cavity in the sill end of the intermediate jamb.

21. A method according to claim 15, wherein the head key post comprises a first head key post, and wherein the head key comprises a second head key post extending away from the head key base along the intermediate jamb axis, wherein the second head key post extends into a second head end cavity in the head end of the intermediate jamb.

22. A method according to claim 15, wherein the interlocking sill connection comprises a sill rail, and wherein the sill end of the intermediate jamb comprises a channel configured to receive the sill rail to form the interlocking connection.

23. A method according to claim 22, wherein the sill rail comprises a sill rail top and wherein the sill key post comprises a sill post end distal from the sill along the intermediate jamb axis, and wherein the sill rail top is located between the sill key base and the sill post end.

24. A method according to claim 15, wherein the interlocking head connection comprises a head rail, and wherein the head end of the intermediate jamb comprises a channel configured to receive the head rail to form the interlocking connection.

25. A method according to claim 24, wherein the head rail comprises a head rail top and wherein the head key post comprises a head post end distal from the head along the intermediate jamb axis, and wherein the head rail top is located between the head key base and the head post end.

26. A method according to claim 15, wherein connecting the first end of the sill jamb and the first end of the head jamb to opposite ends of the first side jamb to form corner joints comprises welding the first end of the sill jamb and the first end of the head jamb to opposite ends of the first side jamb.

* * * * *